US009998821B2

(12) United States Patent
Qin et al.

(10) Patent No.: US 9,998,821 B2
(45) Date of Patent: Jun. 12, 2018

(54) SPEAKER BOX

(71) Applicants: Renxuan Qin, Shenzhen (CN); Jianhua Ding, Shenzhen (CN); Peng Niu, Shenzhen (CN)

(72) Inventors: Renxuan Qin, Shenzhen (CN); Jianhua Ding, Shenzhen (CN); Peng Niu, Shenzhen (CN)

(73) Assignee: AAC ACOUSTIC TECHNOLOGIES (SHENZHEN) CO., LTD, Shenzhen (CN)

( * ) Notice: Subject to any disclaimer, the term of this patent is extended or adjusted under 35 U.S.C. 154(b) by 0 days. days.

(21) Appl. No.: 15/417,206

(22) Filed: Jan. 26, 2017

(65) Prior Publication Data

US 2018/0115820 A1 Apr. 26, 2018

(30) Foreign Application Priority Data

Oct. 25, 2016 (CN) ..... 2016 2 1165206 U

(51) Int. Cl.

*H04R 1/02* (2006.01)
*H04R 1/28* (2006.01)
*H04R 9/06* (2006.01)

(52) U.S. Cl.

CPC ..... *H04R 1/2857* (2013.01); *H04R 1/02* (2013.01); *H04R 1/025* (2013.01); *H04R 1/2807* (2013.01); *H04R 1/2842* (2013.01); *H04R 9/06* (2013.01); *H04R 2499/11* (2013.01)

(58) Field of Classification Search

CPC ..... H04R 1/025; H04R 1/225; H04R 1/2807; H04R 1/2842; H04R 1/2857; H04R 9/06; H04R 2400/11; H04R 2499/11; H04R 1/02; H04M 1/03; H04M 1/035

USPC ..... 381/337, 338, 345, 347, 350, 351, 386, 381/391, 189; 379/420.02, 433.02, 432; 455/350, 569.1, 575.1

See application file for complete search history.

(56) References Cited

U.S. PATENT DOCUMENTS

| | | | | |
|---|---|---|---|---|
| 6,758,303 | B2 * | 7/2004 | Zurek | H04M 1/035 181/155 |
| 7,233,678 | B2 * | 6/2007 | Erixon | H04M 1/035 381/345 |
| 7,953,461 | B2 * | 5/2011 | Fukazawa | H04M 1/03 455/569.1 |
| 2013/0223655 | A1 * | 8/2013 | Lee | H04M 1/035 381/189 |

(Continued)

*Primary Examiner* — Huyen D Le
(74) *Attorney, Agent, or Firm* — Na Xu; IPro, PLLC

(57) ABSTRACT

The present disclosure provides a speaker box, including an upper cover plate and a lower cover plate which cooperate with each other to form accommodating space and a speaker accommodated in the accommodating space, the speaker includes a diaphragm for vibrating and sounding, the diaphragm and the upper cover plate form a front cavity, the speaker box further includes a sounding channel formed by surrounding of the upper cover plate and the lower cover plate, configured to communicate the front cavity with external environment, and a sounding hole communicated with the sounding channel, the speaker is fixed on the upper cover plate, the sounding hole is provided on the lower cover plate, an extending direction of the sounding channel is perpendicular to a vibration direction of the diaphragm. By adopting the speaker of the present disclosure, the assembling yield is high and the sounding effect is good.

4 Claims, 4 Drawing Sheets

(56) References Cited

U.S. PATENT DOCUMENTS

2015/0181344 A1* 6/2015 Jiang ..... H04R 31/006
381/400

* cited by examiner

SPEAKER BOX

TECHNICAL FIELD

The present disclosure relates to the field of electro-acoustic transducer and, in particular, to a speaker box.

BACKGROUND

In recent years, with the booming development of information technology, the audio devices are widely applied. The requirements on audio devices do not only concern video and audio play, but also concern reliability of the audio devices. In particular, together with the 4G generation, mobile multi-media technology is developing fast, many audio devices have entertaining functions such as video play, digital camera, games, GPS navigation etc., all of which require more precise and compact electronic components to be used in the audio devices. However, the more the electronic components, the worse the reliability of the audio device. In the audio device, the speaker box is a common electronic component, which is main used for playing audio signals.

In the related art, positioning structure and sounding hole of the speaker box are generally provided on a same cover plate, since the surface of the cover plate where the sounding hole is located needs to be processed by laser direct structuring (Laser Direct Structuring, LDS), so that the cover plate part has certain accuracy loss, which leads to low assembling yield; moreover, the design of the sounding channel cannot achieve good sounding effect.

Therefore, there is a necessity to provide a new speaker box, so as to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and following embodiments.

Figure 1:
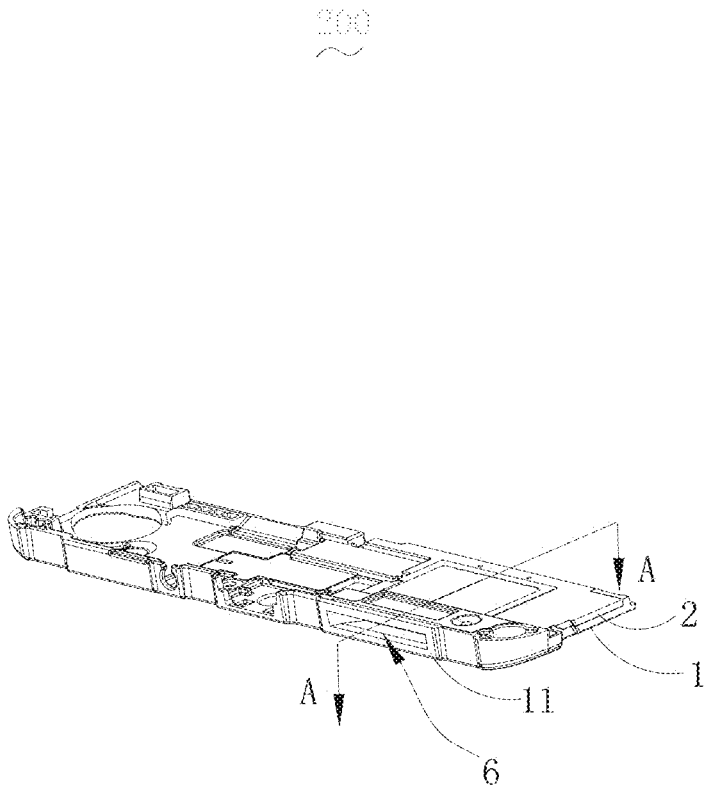
FIG. 1 is a perspective view of a speaker box in accordance with the present disclosure.
Figure 2:
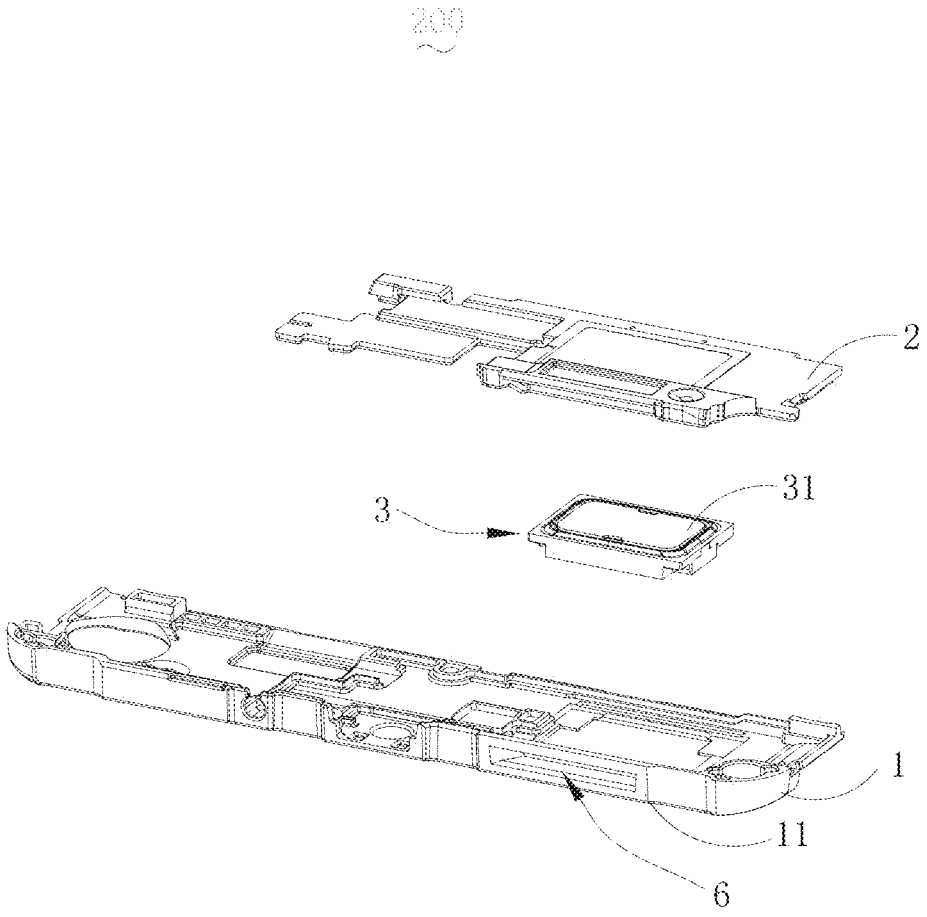
FIG. 2 is a perspective structural view of the speaker box shown in FIG. 1.
Figure 3:
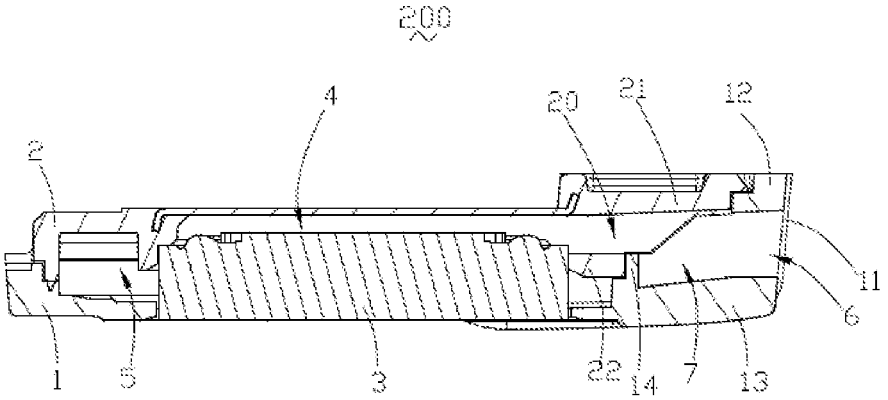
FIG. 3 is a sectional view along A-A line in FIG. 1.
Figure 4:
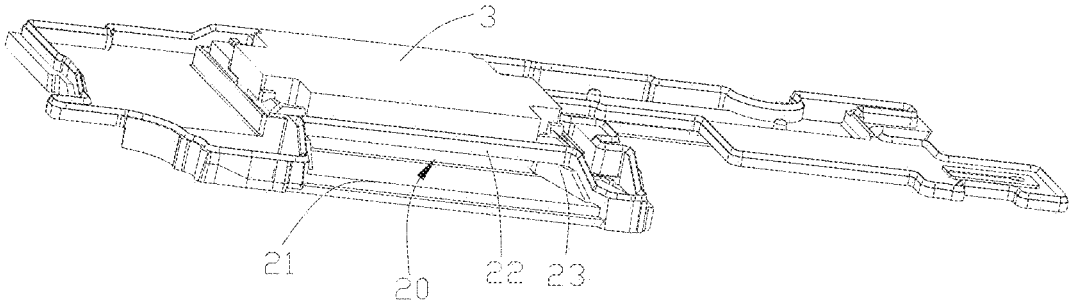
FIG. 4 is an assembling view of an upper cover and a speaker shown in FIG. 1.

Please refer to FIGS. 1-4, FIG. 1 is a perspective view of a speaker box in accordance with the present disclosure; FIG. 2 is a perspective structural view of the speaker box shown in FIG. 1; FIG. 3 is a sectional view along A-A line in FIG. 1; FIG. 4 is an assembling view of an upper cover and a speaker shown in FIG. 1. The speaker box 200 includes a lower cover plate 1 and an upper cover plate which cooperate with each other to form accommodating space, and a speaker 3 accommodated in the accommodating space.

The speaker 3 includes a diaphragm 31 for vibrating and sounding, the diaphragm 31 forms, together with the upper cover plate 2, a front cavity 4. The lower cover plate 1, the upper cover plate 2 and the speaker 3 together surround to form a rear cavity 5, the rear cavity 5 is internally communicated with the speaker 3.

The lower cover plate 1 includes a side wall 11 provided with a sounding hole 6, a first surrounding body 12 and a second surrounding body 13 which are parallel to each other, and a third surrounding body 14 formed by extending of the second surrounding body 13 towards the accommodating space. Optionally, the third surrounding body 14 is perpendicular to the second surrounding body 13. An extending direction of an inner surface (a surface towards the first surrounding body 12) of the second surrounding body 13 is parallel to an extending direction of an inner surface (a surface towards the second surrounding body 13) of the first surrounding body 12.

The upper cover plate 2 includes a fourth surrounding body 21 configured to surround to form, together with the lower cover plate 1, a sounding channel 7, a fixing portion 22 parallel to the fourth surrounding body 21 and is provided between the speaker 3 and the third surrounding body 14, and a connecting wall 23 connecting the fixing portion 22 with the fourth surrounding body 21. The connecting wall 23, the fourth surrounding body 21 and the fixing portion 22 together surround to form a communicating channel 20. The fourth surrounding body 21 is clamped with the first surrounding body 12, and inner surfaces (a surface towards the second surrounding body 13) thereof are parallel to each other, optionally, the inner surfaces thereof are level with each other. An end of the fixing portion 22 is clamped with the speaker 3, the other end abuts with the third surrounding body 14, an upper surface (a surface facing the fourth surrounding body 21) of the fixing portion 22 is level with an upper surface of the third surrounding body 14. The communicating channel 20 is communicated with the front cavity 4.

After the upper cover plate 2 is assembled with the lower cover plate 1, the fourth surrounding body 21, the first surrounding body 12, the side wall 11, the second surrounding body 13 and the third surrounding body 14 together surround to form the sounding channel 7. The communicating channel 20 is configured to communicate the front cavity 4 with the sounding channel 7. The sounding channel 7 formed as such is arranged to be flat and straight, and an extending direction of the sounding channel 7 is provided perpendicular to the vibrating direction of the diaphragm 31, so that the sounding is flexible, and the sounding effect is good. The extending direction of the sounding channel 7 is the direction along which the sounding hole 6 is communicated with the external environment. Through arranging the fixing structure and sounding hole 6 of the speaker 3 respectively on the upper cover plate 2 and the lower cover plate 1, so that the lower cover plate 1 which needs LDS does not need to include a positioning structure of the speaker 3, so as to avoid accuracy loss by the positioning structure of the speaker 3, thereby improving assembling yield of the product.

A notch is formed at the connection position of the first surrounding body 12 and the fourth surrounding body 21, the notch is coated with sealing glue.

The lower cover plate 1 is provided with a ultrasonic sealing layer (not shown) for sealing the rear cavity 5 at the connection position of the upper cover plate 2 and the lower cover plate 1, the sealing layer is arranged by surrounding the profile of the connection position of the upper cover plate 2 and the lower cover plate 1, so as to obtain better sealing performance to the rear cavity 5.

The sounding hole 6 is of a rectangular shape or a circular shape. Obviously, the shape of the sounding hole 6 is not limited to circular shape or rectangular shape, and can also be pentagon, triangle, trapezoid or irregular shape etc.

Comparing with the related art, in the speaker box 200 provided by the present disclosure, the fixing structure and the sounding hole 6 of the speaker 3 are respectively arranged on the upper cover plate 2 and the lower cover plate 1, so that the lower cover plate 1 which needs LDS does not need to include a positioning structure of the speaker 3, so as to avoid accuracy loss by the positioning structure of the speaker 3, thereby improving assembling yield of the product. The extending direction of the sounding channel 7 is provided perpendicular to the vibrating direction of the diaphragm 31, so that the sounding is flexible, and the sounding effect is good.

The above merely shows embodiments of the present disclosure, it should be noted that, improvements can be made by those skilled in the art without departing from the inventive concept of the present disclosure, however, these shall belong to the protection scope of the present disclosure.

What is claimed is:

1. A speaker box, comprising:

an upper cover plate;

a lower cover plate, wherein the upper cover plate and the lower cover plate cooperate with each other to form accommodating space;

a speaker, wherein the speaker is accommodated in the accommodating space;

a sounding channel, formed by surrounding of the upper cover plate and the lower cover plate; and a sounding hole, communicated with the sounding channel and provided on the lower cover plate;

wherein the speaker comprises a diaphragm for vibrating and sounding, the diaphragm and the upper cover plate form a front cavity, the sounding channel is configured to communicate the front cavity and an external environment, an extending direction of the sounding channel is perpendicular to a vibration direction of the diaphragm, the lower cover plate comprises a side wall arranged parallel to the vibrating direction of the diaphragm, a first surrounding body and a second surrounding body which are perpendicular to the side wall and are parallel to each other, and a third surrounding body formed by the second surrounding body extending towards the accommodating space, the sounding hole is provided on the side wall, the upper plate comprises a fourth surrounding body, a fixing portion provided parallel to the fourth surrounding body and configured to clamp and hold the speaker, and a connecting wall for connecting the fixing portion with the fourth surrounding portion, the fourth surrounding body, the connecting wall and the fixing portion together surround to form a communicating channel, the communicating channel connects the front cavity with the sounding channel.

2. The speaker box as described in claim 1, wherein the fourth surrounding body is clamped with the first surrounding body and inner surfaces thereof are parallel to each other, the fixing portion abuts with the third surrounding body, an upper surface of the fixing portion is level with an upper surface of the third surrounding body; the fourth surrounding body, the first surrounding body, the side wall, the second surrounding body and the third surrounding body together surround to form the sounding channel.

3. The speaker box as described in claim 1, wherein a connecting position of the lower cover plate and the upper cover plate is provided with a ultrasonic sealing layer.

4. The speaker as described in claim 1, wherein the sounding hole is of a rectangular shape or a circular shape.

* * * * *